United States Patent [19]

Bredow

[11] 4,434,639

[45] Mar. 6, 1984

[54] ARRANGEMENT FOR PRODUCING DRAWN FORMATIONS ON WORKPIECES, PARTICULARLY IN A CUTTING AND PRESSING MACHINE

[75] Inventor: Walter Bredow, Alfeld, Fed. Rep. of Germany

[73] Assignee: C. Behrens AG, Alfeld, Fed. Rep. of Germany

[21] Appl. No.: 311,296

[22] Filed: Oct. 14, 1981

[30] Foreign Application Priority Data

Nov. 8, 1980 [DE] Fed. Rep. of Germany ..... 3042158

[51] Int. Cl.[3] ..... B11D 45/00

[52] U.S. Cl. ..... 72/344; 72/345; 72/348; 72/427

[58] Field of Search ..... 72/347, 348, 349, 344, 72/345, 427; 83/81, 82

[56] References Cited

U.S. PATENT DOCUMENTS

| | | | |
|---|---|---|---|
| 1,474,066 | 11/1923 | Brown | 72/347 |
| 2,377,262 | 5/1945 | O'Leary | 83/81 |
| 2,861,335 | 11/1952 | Huet | 72/358 |
| 2,976,753 | 3/1961 | Fowler | 83/82 |
| 3,051,830 | 8/1962 | Swain | 219/149 |
| 3,137,067 | 6/1964 | Bruecker | 72/347 X |
| 3,148,571 | 9/1964 | Wallis | 83/82 |
| 3,893,358 | 7/1975 | Dixon | 83/82 |
| 3,913,372 | 10/1975 | Baker | 72/348 |
| 4,210,013 | 7/1980 | Miller | 72/347 |

*Primary Examiner*—Leon Gilden

*Attorney, Agent, or Firm*—Michael J. Striker

[57] ABSTRACT

A drawing arrangement for producing drawn formations in sheet-shaped workpieces includes a lower tool having a supporting surface for the workpieces and a recess which opens onto the supporting surface, and an upper tool having a female die and movable toward and away from the lower tool for confining a region of the workpiece between itself and the supporting surface. A mandrel is mounted in the recess of the lower tool for movement between a retracted position in which it is fully accommodated in the recess and thus does not project beyond the supporting surface and form an obstruction to the movement of the workpiece, and an extended position in which it penetrates into the female die and forms the drawn formation in the workpiece. The punch is mountd on an actuating member which has a lower contact surface, and the movement of the actuating member is achieved by a lifting device which has an operating member movable toward and out of contact with the contact surface, and a spring which urges the actuating member toward its retracted position. During the retraction movement, the punch itself acts as a stripping tool for the workpiece. A descending chute can be interposed between the actuating and operating members and has a pivotable section movable out of the path of movement of the operating member. The operating member may move at different speeds during approach to the actuating member and thereafter.

9 Claims, 4 Drawing Figures

TO
17
20
18
22
h
13
7d
15
6a
7

TO
17
18
22
13
20
h
7d
7
15
6a

ARRANGEMENT FOR PRODUCING DRAWN FORMATIONS ON WORKPIECES, PARTICULARLY IN A CUTTING AND PRESSING MACHINE

BACKGROUND OF THE INVENTION

The present invention relates to an arrangement for producing drawn formations on plate-shaped or sheet-shaped workpieces in general, and more particularly to an arrangement of this type for use in a pressing and cutting machine, especially such having a numerically controlled coordinate table, a vertically movable upper tool having a die, and a lower tool carrying an associated punch.

In the treatment of plate-shaped or sheet-shaped workpieces or, generally speaking, in the sheet metal working field, it is often necessary to produce drawn formations. Such drawn formations include, without limitation thereto, thread formations, air-passage slots or baffles, hollow formations or depressions, and deep-draw formations. In the entire sheet metal working industry, such drawn formations are customarily produced in conventional eccenter presses, so long as no special requirements exist and so long as individual operations are involved. Under such circumstances, the drawing die is provided on the pressing table and the punch is arranged on the upper tool under the ram. This means that the drawn formation, namely the respective depression, is formed in the respective workpiece in the downward direction. This is satisfactory in many applications.

However, when the drawn formations are to be formed on a cutting and pressing machine cooperating with a numerically controlled coordinate table, this working procedure is no longer acceptable, inasmuch as the just produced drawn formation would be destroyed or damaged during the transportation of the workpiece into the next-following position. In order to avoid such destruction or damage, it was necessary to reverse the working procedure, that is, to mount the punch on the lower tool and to provide the drawing die on the upper tool. The present invention is based on a drawing arrangement of this type.

Experience with this type of drawing arrangement has shown that the workpiece remains stuck on the punch which, in this case, constitutes a drawing mandrel, after the termination of the drawing operation, so that it has to be removed from the punch by a special stripping tool. In the known drawing arrangements of this type, the punch is rigidly connected with the lower tool, in such a manner that at least its most prominent portion extends above the surrounding area of the lower tool, that is, the support surface for the workpiece, at least to a distance corresponding to the drawing depth, in order to assure an unproblematical stripping. However, such a construction is possessed of grave disadvantages. On the one hand, the free space between the drawing die and the stripping tool as it is customarily provided is narrowed thereby, with the consequence that, ultimately, even the drawing depth is limited. On the other hand, the tool plane of the cutting and pressing machine, that is, the plane determined by the support surfaces for the workpieces, does not remain level with the often used tool magazine; rather, an elevated portion, or a plurality of elevated portions, extends upwardly of the aforementioned plane, and the workpiece must be transported over such elevated portion or portions. This has further the consequence that, when a tool magazine, such as an indexing turret carrying the tools, is being used, the operating stations which are arranged adjacently to the drawing station equipped with the rigid punch or mandrel can no longer be used for normal cutting operations.

SUMMARY OF THE INVENTION

Accordingly, it is a general object of the present invention to avoid the disadvantages of the prior art.

More particularly, it is an object of the present invention to provide a drawing arrangement which is not possessed of the disadvantages of the conventional drawing arrangements.

It is a further object of the present invention to so construct the drawing arrangement as to be usable in cutting and drawing machines.

Still another object of the present invention is to devise a drawing arrangement of the type here under consideration in which all support surfaces for the workpieces, inclusive of possibly provided stripping tools for special tools, such as threaded funnel forming tools, are arranged in a common plane.

Yet another object of the invention is so to design the drawing arrangement of this type as to be usable in cooperation with tool magazines, such as indexing turrets or the like without interference therewith and without damage to the just produced drawn formation during further transportation of the workpiece.

It is an additional object of the present invention to develop a drawing arrangement which can be used at a drawing station of the cutting and pressing machine and does not interfere with performance of normal cutting operations at the adjoining stations of the machine.

A concomitant object of the invention is to provide a drawing arrangement of the above type which is simple in construction, easy to manufacture and assemble, and reliable in operation nevertheless.

In pursuance of these objects and others which will become apparent hereafter, one feature of the present invention resides in a drawing arrangement, particularly for use in a cutting and pressing machine having a numerically controlled coordinate table, for producing drawn formations on workpieces, the drawing arrangement comprising, briefly stated, a support; a first tool mounted on the support and having a supporting surface for the workpieces arranged in a predetermined plane and a recess which opens onto the supporting surface; a second tool mounted on the support for movement in opposite directions toward and away from the first tool upto area contact with the respective workpiece at the supporting surface and including a female drawing die aligned in the opposite directions with the recess of the first tool; and a drawing punch mounted on the first tool within the recess thereof for movement between an extended position in which it extends beyond the supporting surface toward the female drawing die and a retracted position in which it is fully retracted into the recess of the first tool and is at most flush with the supporting surface of the first tool. Advantageously, the tools are so arranged that the supporting surface of the first tool faces upwardly and the second tool is mounted on the support upwardly of the plane of the supporting surface for movement in substantially vertical directions.

In this manner, there is provided a male tool, particularly a lower tool, of the drawing arrangement of the type here under consideration, in which the male punch conducts a movement toward and away from the female die, especially up and down movement. After the termination of its reciprocatory movement, that is, after its return into the retracted position, the male punch is situated to the other side of the predetermined plane from the female die, that is, it does not project beyond this plane toward the female tool, so that it does not constitute an obstruction of any kind to the transportation of the workpiece any longer. In addition thereto, a stripping operation is performed as a result of the retracting movement of the male punch itself. With tool magazines, such as especially indexing turrets, all supporting surfaces for the workpiece, inclusive of the possibly needed stripping tools therefor, can be arranged along a common plane. The workpiece, that is, especially a plate or metal sheet, can be transported or shifted without any hindrance in a controlled manner by the coordinate table. The female drawing die conducts merely a lowering movement during which it comes to rest on the upper surface of the respective workpiece, so as to thereafter act, in the customary manner, as a reaction member for the drawing movement of the lower tool.

In a construction according to the present invention which is particularly advantageous as far as its construction and also its operation is concerned, the male punch is carried by an actuating member or bolt, the actuating member being movable in extending and retracting directions relative to the first or lower tool, and there are provided abutment means for delimiting the extent of movement of the actuating member in the retracting direction, biasing means including at least one spring for urging the actuating member in the retracting direction toward the abutment means, and means for moving the actuating member in opposition to the force of the biasing means in the extending direction, including a lifting device disposed below the first tool and acting on the actuating member. Then, the actuating member may have a lower contact surface acted upon by the lifting device. When this construction is used, there is obtained the advantage that the first or lower tool, inclusive of the male punch and the actuating member, can be arranged and guided on a customary tool carrier, and the lifting device can act from below the tool carrier against the lower contact surface of the actuating member. The first or lower tool with the male punch and with the actuating member, as well as with a return spring can be arranged in a conventional manner in or on a tool carrier, especially in or on a tool magazine, such as an indexing turret, next to other tools, particularly usual cutting tools. In this manner, always controlled by the coordinate table, any initial operations can be carried out first by means of the cutting tools, at the desired locations, on the cutting machine, whereupon the respectively desired drawn formations can be formed at the previously created slots or the like by means of the drawing arrangement according to the present invention.

According to a further advantageous facet of the present invention, the actuating member is partially accommodated in the recess of the first or lower tool and has a first annular portion received in the recess and cooperating with the abutment means for delimiting the extent of movement of the actuating member in the retracting direction, and a second annular portion situated upwardly of the contact surface, the return spring then extending between the second annular portion of the actuating member and the first or lower tool within the confines of the latter. In this manner, there is obtained a very compact structural unit which can be easily incorporated in or mounted on the lower tool carrier.

When the cutting and pressing machine is of the type in which a descending chute is arranged on the support below the first or lower tool, this descending chute serving for conveying the discards, that is, pieces which are cut out from the workpieces by the per se customary cutting tools which adjoin the arrangement according to the present invention, as is customary in cutting and pressing machines equipped with a tool magazine and especially in indexing tool turret pressing and cutting machines, it is advantageous when, in adjustment to these circumstances, the drawing arrangement of the present invention is so constructed that the lifting device has an operating member movable from its first position fully below the descending chute toward its second position in which it extends across the descending chute and contacts the contact surface of the actuating member, and back to the first position after the drawing operation, and when a connecting chute section is provided which is movable between a first position in which it extends across the path of movement of the operating member and constitutes a part of the descending chute and a second position in which it is situated out of the path of movement of the operating member. The connecting chute section is advantageously mounted on the descending chute for pivoting relative thereto. It is further advantageous when means is provided for moving the connecting chute section between its positions in dependence on the movement of the operating member.

In cutting and pressing machines of this type, the lifting device is arranged directly underneath the opening for the discards or scrap and the cooperating descending chute and, therefore, the lifting device must be mounted at such a low elevation that the advancement of the scrap or discards on the descending chute can take place without any interference from the actuating device when the latter is not operating, in an unproblematical manner. This is achieved by the above-discussed construction, inasmuch as the connecting chute section interposed in the descending chute is actuated only in the event and during the movement of the operating member of the lifting device, in order to let the operating member freely pass past the deflected connecting chute section, while the latter serves as a constitutent part of the descending chute in the interims between successive operations of the lifting device.

As a result of the relatively low mounting of the lifting device in this construction, there is obtained a relatively huge distance between the contact surface of the actuating member for the male punch and the cooperating surface of the operating member of the lifting device when the operating member is in its rest or first position. In order to take this into consideration in the design of the lifting device, the lifting device is provided, in accordance with another advantageous concept of the present invention, with means for moving the operating member from its first position at a higher speed until the cooperating surface of the operating member contacts the contact surface of the actuating member, and at a lower speed and with a considerable force thereafter during the actual drawing operation.

Consequently, the operating member moves through the aforementioned considerable distance separating the cooperating surface thereof from the contact surface of the actuating member at a high speed while it is being acted upon by a force which is relatively low but still sufficient to achieve such a movement of the operating member, whereas the following movement, which accomplishes the drawing operation, is achieved at a relatively low speed of movement of the operating member, but with a relatively high force, which is necessary to draw the material of the workpiece. A lifting device capable of operating in this manner may be constructed, in accordance with the present invention, as a pneumatically or hydraulically operated cylinder-and-piston unit, or as a combination unit in which pressurized air or similar gaseous medium pressurizes oil or another hydraulic medium, and in which the gaseous medium achieves the relatively rapid approach movement and the pressurized hydraulic medium subsequently achieves the relatively slow but high-force working or drawing movement of the operating and actuating members and of the male punch. There can also be used a cylinder-and-piston unit in which the rapid movement is achieved by using the pressurized hydraulic medium and the following low-speed high-force movement is achieved by a mechanical transmission. However, it is also possible to achieve these differential movements by purely mechanical means, such as spindles with cooperating followers, toggle lever transmissions, angular levers or the like, or combinations of such mechanically operating elements.

It is further advantageous when the support is provided with a transverse beam disposed underneath the descending chute in alignment with the longitudinal axis of the tools, and when the lifting device is mounted on this transverse beam. When this expedient is resorted to, the remainder of the construction of the machine, and particularly the structure of the tool magazine, such as an indexing turret or disk or the like, is not disturbed in any manner; rather, these conventional components of the machine can be constructed in the conventional manner, while all structural elements which are needed for driving the drawing arrangement according to the present invention are disposed in the lower part of the machine in alignment with the longitudinal axis of the tools.

The novel features which are considered as characteristic of the invention are set forth in particular in the appended claims. The improved drawing arrangement as used in a cutting and drawing machine of an otherwise conventional construction itself, however, both as to its construction and its mode of operation, together with additional features and advantages thereof, will be best understood upon perusal of the following detailed description of certain specific embodiments with reference the accompanying drawing.

DETAILED DESCRIPTION OF THE PREFERRED EMBODIMENT

Figure 1:
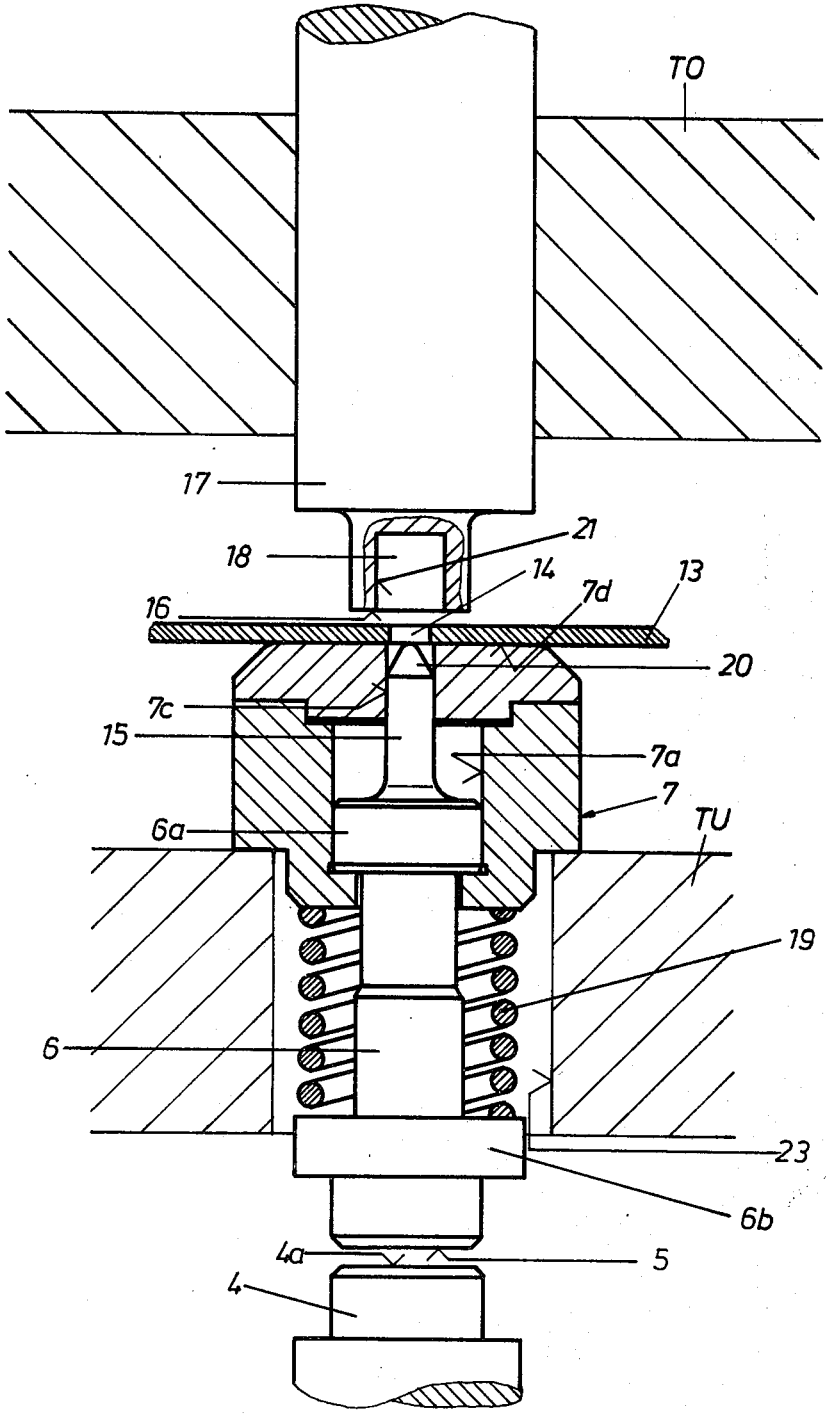
FIG. 1 is an axial sectional view of a tool region of a drawing arrangement of the present invention as used in a cutting and pressing machine in its retracted position.

Referring now to the drawings in detail, it is to be mentioned first that only those parts of the drawing arrangement of the present invention and of the cutting and pressing machine in which it is being used which are needed for an explanation of the invention are illustrated therein, and that, moreover, even such parts are shown in a somewhat diagrammatic fashion.

FIG. 1 shows a tool region of the drawing arrangement of the present invention. An upper tool part 17 is arranged in a diagrammatically illustrated upper tool carrier TO, and is movable in opposite vertical directions with respect to the upper tool carrier TO. The tool part 17 is configurated at its lower region as a female drawing die having a bore or depression 18. The tool part 17, together with the depression 18 of the drawing die, forms an upper tool 17, 18. The upper tool 17, 18 is arranged coaxially with a lower tool 7. The lower tool 7 is mounted on a lower tool carrier TU upwardly of a bore 23 provided in the lower tool carrier TU. The lower tool carrier TU is advantageously constructed as an indexible turret or disk of a turret cutting and pressing machine. A male punch 15 is guided in a recess or bore **7*a* of the lower tool 7 for movement in opposite vertical directions. The punch 15 is illustrated as a drawing mandrel having a tip 20. The punch 15 is carried by an actuating member or bolt 6 and guided in the recess 7*a* by an annular abutment portion 6*a* of the actuating member 6. The annular abutment portion 6*a* supports the punch 15 in the retracted position illustrated in FIG. 1 within the recess 7*a* of the lower tool 7. The punch 15 is further guided in another bore or recess 7*c* provided in the upper region of the lower tool 7 for movement relative to the lower tool 7**.

The actuating member 6 passes through the bore 23 of the lower tool carrier TU and has an annular abutment **6*b* at its lower region. The actuating member 6 further has an extension which extends in the downward direction beyond the annular abutment 6*b* and has at its lower end a contact surface 5. A return compression spring 19 extends between and acts on a lower surface 7*b* of the lower tool 7 and the annular abutment 6*b* of the actuating member 6. The return spring 19 thus urges the actuating member 6, and with it the male punch 15, in the retracting direction. A lifting device, which will be described in more detail later on and which includes an operating member 4, is provided for driving the actuating member 6 and thus the male punch 15 in the upward direction. The operating member 4 has a surface 4*a* which comes into contact with the lower contact surface 5 of the actuating member 6 during upward movement of the operating member 4**.

Figure 3:
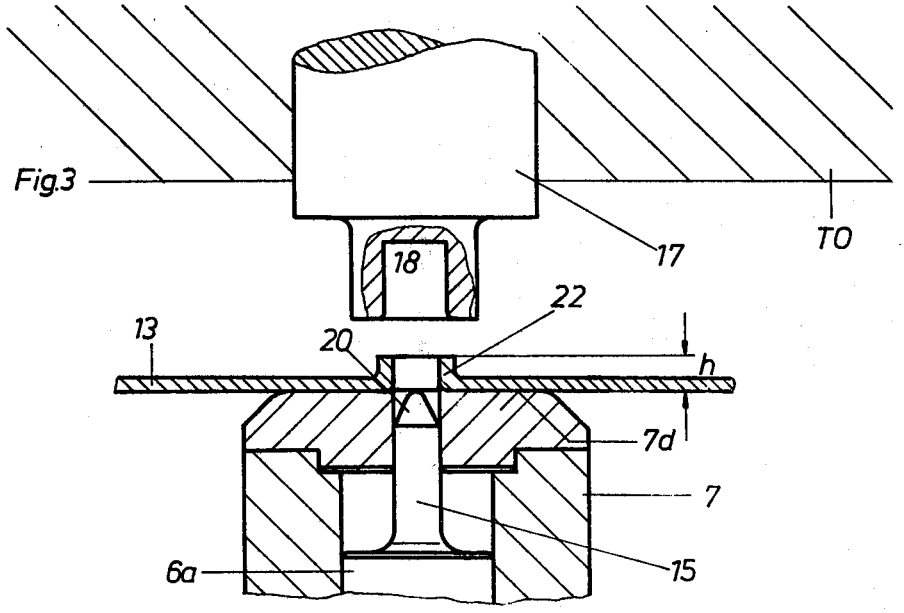
FIG. 3 is a view corresponding to that of FIG. 2 but in the retracted position following the drawing operation.

As a comparison of FIGS. 1 and 3 will show, the tip 20 of the male punch 15 is always located at or below a supporting surface **7*d* of the lower tool 7 for the workpiece 13** when the punch is in its retracted position.

Figure 2:
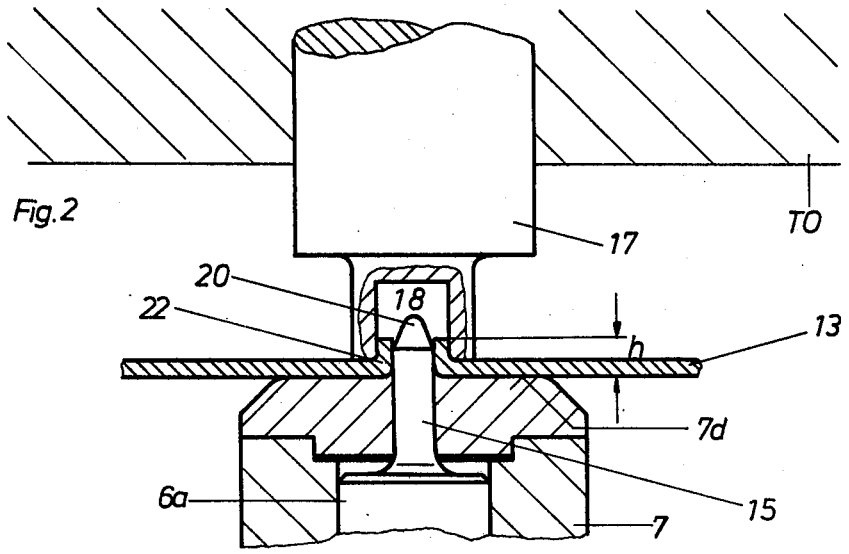
FIG. 2 is an axial sectional view similar to that of FIG. 1 but only of a portion of the tool region and in the extended position.

The operation mode of the drawing arrangement as described so far is as follows: In many instances, the drawn formations to be produced are thread formations made of pre-manufactured holes, and the arrangement of the present invention will be described as used in this particular application; however, it will be appreciated that the arrangement of this invention is not limited to this use. In this application, the corresponding holes or apertures, such as the illustrated aperture 14, are provided in the workpiece 13 in a first manufacturing operation. Then, in a subsequent second manufacturing operation, the thread formations are produced by the drawing arrangement according to the present invention. The workpiece or metal sheet 13 is so positioned with the aid of a coordinate table that the aperture 14 is situated directly above the male punch 15, that is, above the mandrel 15 having the tip 20. This means that the aperture 14 is also correspondingly positioned in a properly corresponding manner with respect to the bore or depression 18 of the female drawing die 17, 18 of the upper tool. Thereafter, a descending stroke of a non-illustrated conventional eccentric drive of the cutting and pressing machine is initiated so that the female drawing die 17, 18 descends and is stopped in its lowermost position, so that, as shown in FIG. 2, a lower surface 16 of the upper tool or female drawing die 17, 18 comes to rest on the upper surface of the respective workpiece 13 and confines the same between itself and the upper or supporting surface 7*d* of the lower tool 7.

Thereafter, the upward movement of the operating member 4, which was previously discussed, is commenced, so that the surfaces 4*a* and 5 contact each other and, after this contact is established, the actuating member 6 is moved against the opposition of the compression spring 19, so that the male punch or mandrel 15 is displaced upwardly and its tip 20 penetrates into the aperture 14. As a result of this upward movement of the mandrel 15, the aperture 14 is widened and, simultaneously therewith, the sheet material of the workpiece 13 is pushed upwardly at a region of the workpiece 13 surrounding the aperture 14 and extending all the way to the maximum diameter of the bore or depression 18 of the female drawing die or upper tool 17, 18. During the further penetration of the male punch 15, there is formed a collar which, on the one hand, contacts a surface 21 which bounds the depression 18 and, on the other hand, firmly surrounds and engages the mandrel or male punch 15, as shown in FIG. 2. The height h of the collar 22 results from the amount of available material, that is, when the aperture 14 is small, the collar 22 is relatively high and, when the aperture 14 is larger, the collar 22 is correspondingly lower. Once the mandrel or male punch 15 has reached its uppermost or extended position, the direction of movement of the operating member 4 is reversed so that the actuating member 6, together with the mandrel or punch 15, moves under the influence of the return compression spring 19 into its retracted position. During this retracting motion, the mandrel 15 is withdrawn from the collar 22, which is akin to the stripping of the workpiece 13 from the mandrel 15. Then, the eccentric drive of the cutting and pressing machine is reactivated so that the upper tool or female drawing die 17, 18 is returned into its originally assumed rest position, and the drive of the machine is stopped once the upper tool 17, 18 has reached its rest position. This position of the arrangement of the present invention is illustrated in FIG. 3 of the drawing. This terminates the operating cycle during which the respective workpiece 13 has been provided with the drawn formation, and the just finished workpiece 13 can now be transported into another position at which, if need be, another drawn formation may be made at a different zone of the workpiece 13.

Figure 4:
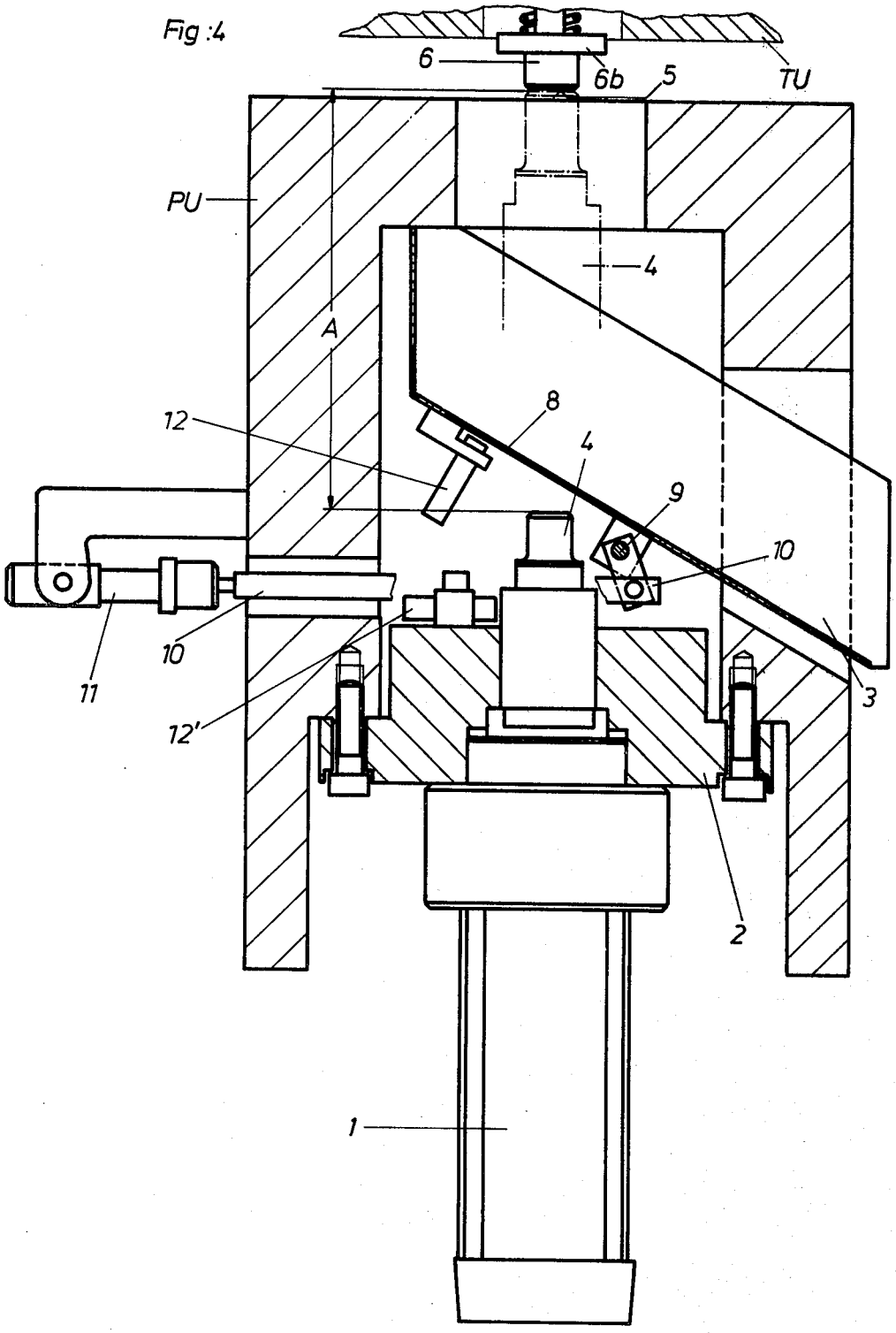
FIG. 4 is an axial sectional view of a lifting device region of the drawing arrangement of FIG. 1.

FIG. 4 shows the driving arrangement for driving the actuating member 6 and thus the mandrel or punch 15, which forms a part of the arrangement of the present invention. The driving arrangement includes a lifting device 1 which, as mentioned above, is constructed to operate at the different speeds. The lifting device 1 is mounted in the lower part PU of the pressing machine by means of a transverse beam 2 in any conventional manner. Inasmuch as in the illustrated construction of the cutting and pressing machine is situated directly underneath the passing-through opening for the cutting remnants, scrap or discards, it is mounted at so low an elevation that the descent of the discards on a descending descending chute or slide can take place in an unproblematical manner. As a result of this, there is obtained a relatively huge distance A between the upper surface 4*a* of the operating member 4 of the lifting device 1 and the lower contact surface 5 of the actuating member 6 of the punch or mandrel 15. This distance A is traversed by the operating member 4 of the lifting device 1 in the above-discussed manner at a rapid pace until the two surfaces 4*a* and 5 engage one another. Then, there follows the already discussed working stroke of the operating member 4 for moving the actuating member 6 and the mandrel 15 into the position illustrated in FIG. 2.

In order to enable the operating member 4 to reach the contact surface 5 of the actuating member 6, the descending chute 3 is made permeable to the operating member 4. To this end, the descending chute 3 is provided with a connecting chute section 8 which is pivotable about a pivoting axle 9. In order to pivot the connecting chute section or flap 8, there is provided a pneumatic cylinder-and piston unit 11 which is mounted on the machine lower part PU and which pivots the connecting section or flap 8 by means of a transmission linkage or rod 10. Pressurized air is admitted into or discharged from the cylinder-and-piston unit 11 in dependence on the movement of the operating member 4 of the lifting device 1 in such a manner that, as the operating member 4 is about to move or has commenced its movement toward the actuating member 6, the transmission linkage or rod 10 pivots the section or flap 8 about the pivoting axle 9 out of the path of movement of the operating member 4. The pivoting movement of the section or flap 8 is continued until the latter is completely removed from the path of movement of the operating member 4 so that the latter can be moved into the position thereof which is indicated in FIG. 4 in broken lines without contacting any section of the descending chute or slide 3. The terminal positions of the connecting section or flap 8 are determined by electric sensing elements 12 or 12', and so is the upper portion of the operating member 4. In this manner, it is avoided that, by reason of incorrect programming or other failure, any part of the arrangement could be damaged during the advancement of the operating member 4.

As a result of the above-discussed arrangement of the lifting device 1 in connection with the modified descending chute 3, 8 and the arrangement of the lifting device 1 in the lower part PU of the machine, it is accomplished, especially in cutting and pressing machines equipped with a tool magazine, especially in an indexible turret or disk cutting and pressing machine equipped with indexible turrets or disks, that the so constructed lower part PU of the machine can be used without any change for operation only with the usual cutting tools.

As the above-discussed example of the embodiment of the present invention shows, the arrangement of the present invention achieves, as one of its important advantages, that all of the supporting surfaces for the workpiece 13 are situated in a common plane even when drawn formations are produced or to be produced in the respective workpiece 13, in that no tool part and especially no mandrel or punch 15 for the production of the drawn formations extends beyond such supporting surface in its retracted position, so that such tool or mandrel 15 does not interfere with the transportation or shifting of the respective workpiece 13 in the initially mentioned manner by the coordinate table and does not damage or destroy the just produced drawn formations.

It will be understood that each of the elements described above, or two or more together, may also find a useful application in other types of arrangements differing from the type described above.

While the invention has been illustrated and described as embodied in a drawing arrangement as used in a cutting and pressing machine equipped with an indexible turret or disk and with a numerically controlled coordinate table, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A drawing arrangement, particularly for use in a cutting and pressing machine having a numerically controlled coordinate table, for producing drawn formations on substantially sheet-shaped workpieces having respective bottom surfaces that travel along a predetermined plane during relative movement between the workpieces and the arrangement, comprising a support; a first tool mounted on said support below said predetermined plane and having an upper supporting surface for supporting the workpieces, permanently arranged in the predetermined plane, and a recess which opens onto said supporting surface; a second tool mounted on said support above the predetermined plane for movement in opposite directions toward and away from said first tool upto area contact with the respective workpiece supported on said supporting surface, and including a female drawing die aligned in said opposite directions with said recess of said first tool; and a drawing punch mounted on said first tool within said recess for movement between an extended position in which it extends beyond said supporting surface toward said female drawing die to deform a portion of the workpiece into the latter and a retracted position in which it is fully retracted into said recess of said first tool and is at most flush with said supporting surface of said first tool in order not to interfere with the movement of the workpiece along the predetermined plane.

2. The drawing arrangement as defined in claim 1; further comprising an actuating member carrying said male punch and movable in extending and retracting directions relative to said first tool; abutment means for delimiting the extent of movement of said actuating member in the retracting direction; biasing means including at least one spring for urging said actuating member toward said abutment means; and means for moving said actuating member in opposition to the force of said biasing means in the extending direction, including a lifting device disposed below said first tool and acting on said actuating member.

3. The drawing arrangement as defined in claim 2, wherein said actuating member has a lower contact surface; and wherein said lifting device acts on said contact surface.

4. The drawing arrangement as defined in claim 3, wherein said actuating member is partially accommodated in said recess and has a first annular portion received in said recess and cooperating with said abutments means to delimit the extent of movement of said actuating member in the retracting direction, and a second annular portion situated upwardly of said contact surface; and wherein said spring extends between said second annular portion of said actuating member and said first tool within the confines of the latter.

5. A drawing arrangement for use in a machine, particularly in a cutting and pressing machine having a numerically controlled coordinate table, in which a descending chute for the discards is arranged on the machine, for producing drawn formations on workpieces, comprising a support; a first tool mounted on said support above the descending chute and having an upwardly facing supporting surface for the workpieces arranged in a predetermined plane and a recess which opens onto said supporting surface; a second tool mounted on said support above said first tool for movement in opposite substantially vertical directions toward and away from said first tool upto area contact with the respective workpiece at said supporting surface and including a female drawing die aligned in said opposite directions with said recess of said tool; a drawing punch mounted on said first tool within said recess for movement between an extended position in which it extends beyond said supporting surface toward said female drawing die and a retracted position in which it is fully retracted into said recess of said first tool and is at most flush with said supporting surface of said first tool; an actuating member carrying said male punch, movable in extending and retracting directions relative to said first tool, and having a lower contact surface; abutment means for delimiting the extent of movement of said actuating member in the retracting direction; biasing means including at least one spring for urging said actuating member toward said abutment means; means for moving said actuating member in opposition to the force of said biasing means in the extending direction, including a lifting device disposed below said first first tool and having an operating member movable from its first position fully below the descending chute toward its second position in which it contacts said contact surface of said actuating member and extends across said descending chute, and back to the first position after the drawing operation; and a connecting chute section movable between a first position in which it extends across the path of movement of said operating member and constitutes a part of the descending chute and a second position in which it is situated out of the path of movement of said operating member.

6. The drawing arrangement as defined in claim 5, wherein said connecting chute section is pivotally mounted on the descending chute.

7. The drawing arrangement as defined in claim 5; and further comprising means for moving said connecting chute section between said first and second positions thereof in dependence on the movement of said operating member.

8. The drawing arrangement as defined in claim 5, wherein said lifting device further includes means for moving said operating member from its first position at a higher speed until said operating member contacts said contact surface of said actuating member, and at a lower speed and with a considerable force thereafter during the drawing operation.

9. The drawing arrangement as defined in claim 5, wherein said support includes a transverse beam disposed underneath the descending chute in alignment with the longitudinal axis of said tools; and wherein said lifting device is mounted on said transverse beam.

* * * * *